US011125126B2

(12) United States Patent
Kimura et al.

(10) Patent No.: US 11,125,126 B2
(45) Date of Patent: Sep. 21, 2021

(54) LUBRICANT SUPPLY APPARATUS FOR INTERNAL COMBUSTION ENGINE

(71) Applicant: TOYOTA JIDOSHA KABUSHIKI KAISHA, Toyota (JP)

(72) Inventors: Koichiro Kimura, Okazaki (JP); Masami Ishikawa, Aichi-gun (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 549 days.

(21) Appl. No.: 16/151,973

(22) Filed: Oct. 4, 2018

(65) Prior Publication Data

US 2019/0186310 A1 Jun. 20, 2019

(30) Foreign Application Priority Data

Dec. 15, 2017 (JP) ..... JP2017-240346

(51) Int. Cl.

| | |
|---|---|
| ***F01M 9/10*** | (2006.01) |
| ***F01L 1/047*** | (2006.01) |
| ***F01M 1/02*** | (2006.01) |
| ***F01M 11/02*** | (2006.01) |
| ***F01M 13/04*** | (2006.01) |

(Continued)

(52) U.S. Cl.

CPC ..... *F01M 9/101* (2013.01); *F01L 1/047* (2013.01); *F01M 1/02* (2013.01); *F01M 11/02* (2013.01); *F01M 13/04* (2013.01); *F01M 13/0416* (2013.01); *F01L 1/053* (2013.01); *F01L 1/18* (2013.01); *F01L 2810/02* (2013.01); *F01M 2013/0433* (2013.01)

(58) Field of Classification Search

CPC ..... F01M 9/101; F01M 11/02; F01L 1/053; F01L 2810/02

See application file for complete search history.

(56) References Cited

U.S. PATENT DOCUMENTS 4,651,704 A * 3/1987 Sekiguchi ..... F01L 1/047 123/572
10,280,812 B1 * 5/2019 Kim ..... F01L 1/0532

(Continued)

FOREIGN PATENT DOCUMENTS

CN 104662266 A 5/2015
JP 61-157112 U 9/1986

(Continued)

*Primary Examiner* — Michael R Mansen
*Assistant Examiner* — Mark K Buse
(74) *Attorney, Agent, or Firm* — Oblon, McClelland, Maier & Neustadt, L.L.P.

(57) ABSTRACT

A lubricant supply apparatus for an internal combustion engine includes a lubricant shower and a baffle plate. The lubricant shower is disposed between a camshaft and a cylinder head cover attached to a cylinder head. The lubricant shower includes a supply port from which a lubricant is supplied to the camshaft. The baffle plate is disposed between the camshaft and the lubricant shower such that a clearance is provided between the baffle plate and the lubricant shower. The baffle plate includes a hole provided at a position at which the hole of the baffle plate overlaps with the supply port of the lubricant shower. The camshaft is provided with a cam. The supply port of the lubricant shower and the hole of the baffle plate are located above the cam.

7 Claims, 3 Drawing Sheets

(51) Int. Cl.
*F01L 1/053* (2006.01)
*F01L 1/18* (2006.01)

(56) References Cited

U.S. PATENT DOCUMENTS

| | | | | |
|---|---|---|---|---|
| 2009/0000591 | A1* | 1/2009 | Kumagai | F01L 1/047<br>123/195 C |
| 2009/0056658 | A1* | 3/2009 | Naito | F01M 1/06<br>123/90.34 |
| 2011/0126786 | A1* | 6/2011 | Kidooka | F01L 1/053<br>123/90.16 |
| 2014/0076266 | A1* | 3/2014 | Honnikoppa | F01M 1/00<br>123/196 R |
| 2015/0260062 | A1 | 9/2015 | Hikita et al. | |
| 2016/0326921 | A1* | 11/2016 | Kira | F01M 1/08 |

FOREIGN PATENT DOCUMENTS

| | | | |
|---|---|---|---|
| JP | 06-030456 | U | 2/1994 |
| JP | 2000-104522 | | 4/2000 |
| JP | 2004-60456 | | 2/2004 |
| JP | 2006-250131 | A | 9/2006 |
| JP | 2007-309096 | A | 11/2007 |
| JP | 2009-62852 | | 3/2009 |

* cited by examiner

LUBRICANT SUPPLY APPARATUS FOR INTERNAL COMBUSTION ENGINE

INCORPORATION BY REFERENCE

The disclosure of Japanese Patent Application No. 2017-240346 filed on Dec. 15, 2017 including the specification, drawings and abstract is incorporated herein by reference in its entirety.

BACKGROUND

1. Technical Field

The disclosure relates to a lubricant supply apparatus for an internal combustion engine.

2. Description of Related Art

When cams provided on camshafts of an internal combustion engine push rocker arms, intake valves and exhaust valves are opened and closed. A lubricant (e.g., lubricating oil) is supplied in order to reduce wear of these members.

A pump configured to pump (i.e., pressure-feed) the lubricant is driven by the internal combustion engine. Thus, an increase in the amount of lubricant leads to an increase in the loads on the pump and the internal combustion engine. This may be a factor contributing to reduction in the fuel efficiency. For this reason, it is desirable to reduce the amount of lubricant. There is, for example, a technology in which a lubricant is squirted out of cams, and, in addition, the lubricant is delivered by drops from recessed portions of a baffle plate disposed above camshafts (see, for example, Japanese Unexamined Patent Application Publication No. 2009-62852 (JP 2009-62852 A)).

SUMMARY

However, the complicated structure of the baffle plate in the foregoing technology may lead to a cost increase. In view of this, the disclosure provides a lubricant supply apparatus for an internal combustion engine, which is simply structured and is configured to supply a smaller amount of lubricant.

An aspect of the disclosure relates to a lubricant supply apparatus for an internal combustion engine. The lubricant supply apparatus includes a lubricant shower and a baffle plate. The lubricant shower is disposed between a camshaft and a cylinder head cover attached to a cylinder head. The lubricant shower includes a supply port from which a lubricant is supplied to the camshaft. The baffle plate is disposed between the camshaft and the lubricant shower such that a clearance is provided between the baffle plate and the lubricant shower. The baffle plate includes a hole provided at a position at which the hole of the baffle plate overlaps with the supply port of the lubricant shower. The camshaft is provided with a cam. The supply port of the lubricant shower and the hole of the baffle plate are located above the cam.

In the above aspect, the lubricant shower may include a nozzle protruding toward the camshaft, the nozzle may be provided with the supply port, the nozzle may be partially disposed in the hole of the baffle plate, and an inner wall of the baffle plate, which defines the hole, may be apart from the nozzle.

In the above configuration, a lower end of the nozzle may be located closer to the camshaft than a lower surface of the baffle plate is.

In the above aspect, the lubricant may be supplied to the lubricant shower by a pump.

In the above aspect, the baffle plate may include a slanted portion that is provided around the hole and that is slanted toward the cam.

In the above aspect, a groove may be provided in an upper surface of the baffle plate.

In the above aspect, a slit may be provided in the baffle plate.

According to the above aspect, it is possible to provide the lubricant supply apparatus for an internal combustion engine, which is simply structured and is configured to supply a smaller amount of lubricant.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Example Embodiment

Figure 1A:
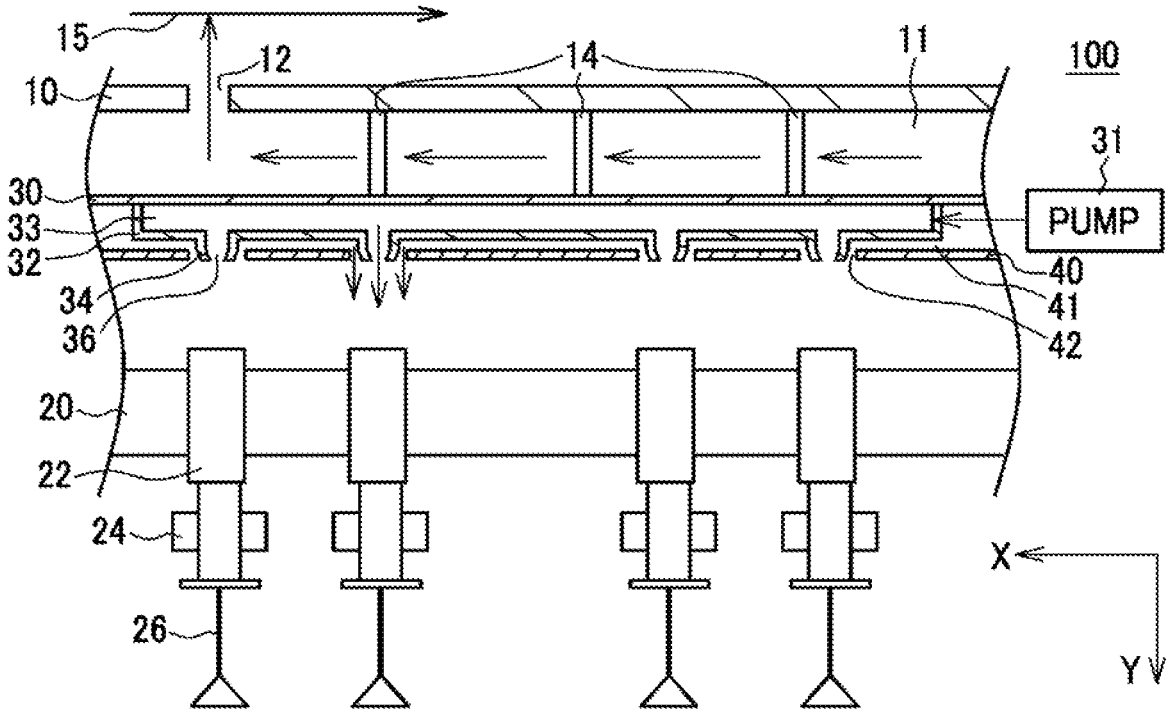
FIG. 1A is a sectional view illustrating a lubricant supply apparatus.

Hereinafter, a lubricant supply apparatus for an internal combustion engine according to an example embodiment will be described with reference to the accompanying drawings. FIG. 1A is a sectional view illustrating a lubricant supply apparatus 100. The lubricant supply apparatus 100 is mounted in, for example, a vehicle, such as an automobile. The lubricant supply apparatus 100 is applied to an internal combustion engine (hereinafter, simply referred to as "engine" where appropriate), such as a gasoline engine or a diesel engine. The internal combustion engine may be, for example, a multi-cylinder engine, such as a four-cylinder engine.

A cylinder head cover 10 illustrated in FIG. 1A is attached to a cylinder head (not illustrated). Camshafts 20 are accommodated in the cylinder head cover 10. A plate 30 is disposed between the cylinder head cover 10 and the camshafts 20. The plate 30 is attached to a lower side of the cylinder head cover 10. A lubricant shower 32 for cams is disposed between the plate 30 and the camshafts 20. A baffle plate 40 is disposed between the camshafts 20 and the lubricant shower 32. The cylinder head cover 10, the lubricant shower 32, the plate 30, and the baffle plate 40 are each made of, for example, a resin material, or a metal material, such as an aluminum alloy.

A gas passage 11 is defined between the plate 30 and the cylinder head cover 10, and blow-by gas flows through the gas passage 11. The cylinder head cover 10 is provided with a plurality of partition walls 14. The partition walls 14 protrude downward (in a Y-direction indicated in the drawings), so that spaces are defined between the partition walls 14 and inner walls of the gas passage 11 in a downward direction or in a direction perpendicular to the sheet on which FIG. 1A is drawn. The blow-by gas flows into the gas passage 11 from an exhaust passage of the engine, and then flows through the gas passage 11 while colliding with the partition walls 14. As a result, gas-liquid separation is performed, so that a lubricant is removed from the blow-by gas. The blow-by gas that has undergone the gas-liquid separation is introduced into an intake passage 15 through an exhaust port 12 of the cylinder head cover 10. The blow-by gas that has flowed into the intake passage 15 is introduced into combustion chambers of the engine together with an intake air, and is then burned in the combustion chambers.

Each camshaft 20 is provided with a plurality of cams 22, and the cams 22 are respectively in contact with rocker arms 24. Valves 26 are respectively in contact with the rocker arms 24. Each of the valves 26 is an intake valve of the engine or an exhaust valve of the engine. When an air-fuel mixture containing fuel and air is burned, a crankshaft of the engine rotates, and a rotational force is transmitted to the camshafts 20 through, for example, a chain. As a result, each camshaft 20 and the cams 22 rotate about an X-axis as a rotational axis. The rotation of the cams 22 causes the rocker arms 24 to oscillate. As a result, the valves 26 make up-and-down reciprocating motions, thereby opening and closing intake ports and exhaust ports of the cylinder head.

Figure 1B:
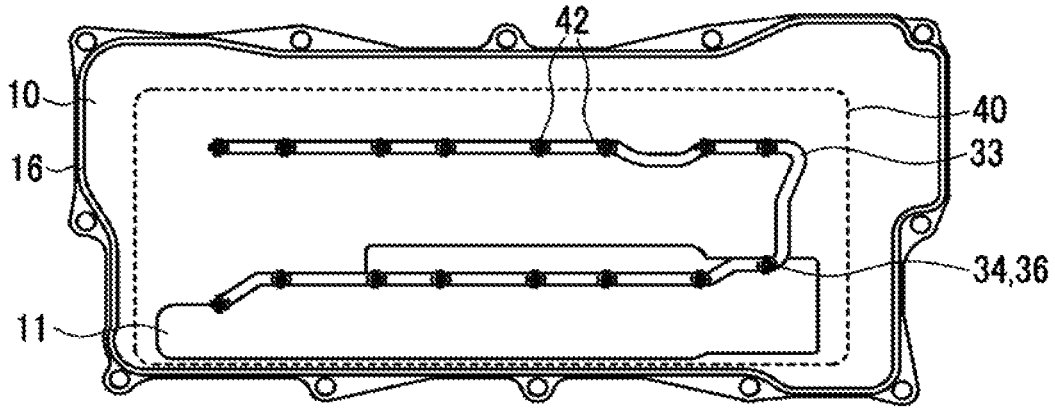
FIG. 1B is a plan view illustrating a cylinder head cover.

FIG. 1B is a plan view illustrating the cylinder head cover 10. In FIG. 1B, the baffle plate 40 is indicated by a dotted line. As illustrated in FIG. 1B, a seal member 16 is disposed at a peripheral edge portion of a lower surface of the cylinder head cover 10. The lubricant shower 32 is disposed below the cylinder head cover 10. The lubricant shower 32 includes a plurality of nozzles 34. Each of the nozzles 34 is provided with a supply port 36. As indicated by the dotted line, the baffle plate 40 covers the gas passage 11 and the lubricant shower 32.

Figure 2A:
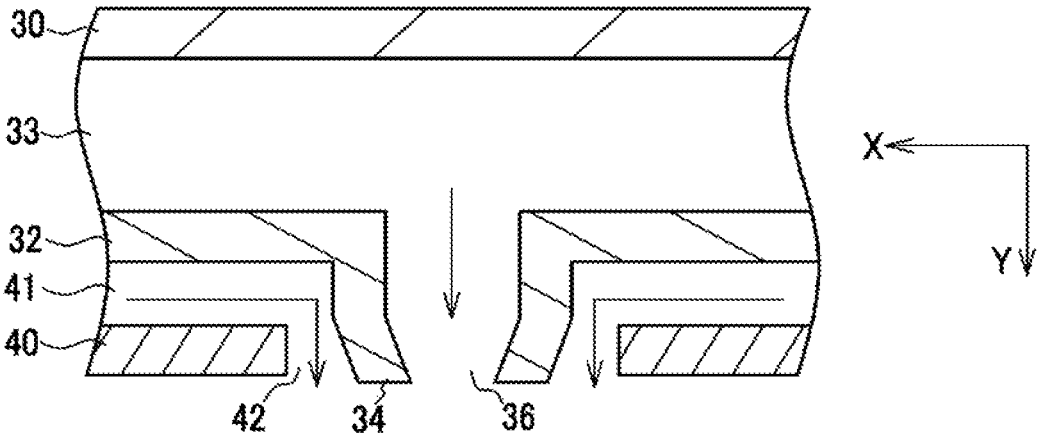
FIG. 2A is an enlarged view illustrating a hole of a baffle plate and a nozzle of a lubricant shower.

FIG. 2A is an enlarged view of a hole 42 of the baffle plate 40 and the nozzle 34 of the lubricant shower 32. As illustrated in FIG. 1A and FIG. 2A, a reservoir chamber 33 is defined between the lubricant shower 32 and the plate 30. The lubricant supplied from a pump 31 is accumulated in the reservoir chamber 33. The nozzles 34 of the lubricant shower 32 protrude downward. The supply port 36 is provided at a distal end of each nozzle 34. The nozzles 34 and the supply ports 36 are located immediately above (i.e., directly above) the cams 22. More specifically, the supply port 36 of each nozzle 34 is located immediately above a corresponding one of the cams 22. The lubricant that has been accumulated in the reservoir chamber 33 is supplied to the cams 22 from the supply ports 36. The lubricant reduces, for example, wear and seizure of the camshafts 20, the cams 22, the rocker arms 24 and so forth.

The amount of lubricant to be supplied from the lubricant shower 32 to the cams 22 can be increased by increasing the discharge rate of the pump 31. However, an increase in the discharge rate of the pump 31 leads to reduction in the fuel efficiency of the engine, because the pump 31 is driven by the engine. Collecting and reusing the lubricant scattered from the cams 22 is effective in reducing the discharge rate of the pump 31.

The baffle plate 40 is a flat plate. The baffle plate 40 is provided with a plurality of the holes 42. The baffle plate 40 is disposed apart from the lubricant shower 32, so that a clearance 41 is provided between the baffle plate 40 and the lubricant shower 32. Each hole 42 extends through baffle plate 40 in the up-down direction. The diameter of the hole 42 is greater than the diameter of the nozzle 34. The nozzle 34 is partially disposed in the hole 42. An inner wall of the baffle plate 40, which defines the hole 42, is apart from the nozzle 34, so that a clearance is provided between the inner wall of the baffle plate 40 and the nozzle 34. In the Y-direction indicated in the drawings, a lower end of the nozzle 34 is located closer to the camshaft 20 than a lower surface of the baffle plate 40 is. That is, the distance between the lower end of the nozzle 34 and the camshaft 20 is less than the distance between the lower surface of the baffle plate 40 and the camshaft 20. The nozzles 34 and the holes 42 are located immediately above the cams 22. More specifically, each nozzle 34 and the hole 42 in which the nozzle 34 is disposed are located immediately above a corresponding one of the cams 22.

When the camshafts 20 and the cams 22 rotate, the lubricant is scattered. A part of the scattered lubricant collides with the lower surface of the baffle plate 40, and then partially enters the clearance 41 from end portions of the baffle plate 40. The lubricant that has entered the clearance 41 drops onto an upper surface of the baffle plate 40, flows on the baffle plate 40, and then gravitationally drops onto the cams 22 from the holes 42. In this way, the lubricant is reused.

According to the present embodiment, the lubricant is introduced onto the baffle plate 40 disposed apart from the lubricant shower 32, and is then supplied to the cams 22 from the holes 42 of the baffle plate 40. That is, the lubricant scattered from the cams 22 can be collected by the baffle plate 40 and the collected lubricant can be reused. As a result, it is possible to reduce the amount of lubricant to be supplied from the lubricant shower 32. In addition, the baffle plate 40 is a plate provided with the holes 42. Because the baffle plate 40 is simply-structured, the baffle plate 40 is low in cost. That is, with such a simple structure according to the present embodiment, it is possible to reduce the amount of lubricant.

Because the amount of lubricant to be supplied from the lubricant shower 32 can be reduced, the discharge rate of the pump 31 can also be reduced. As a result, the loads on the pump 31 and the engine are reduced, so that the fuel efficiency of the engine improves.

The lubricant shower 32 includes the nozzles 34 protruding toward the camshafts 20, and the nozzles 34 are partially disposed in the holes 42. The lubricant that has adhered to a surface of the lubricant shower 32 flows along the nozzles 34 and then drops onto the cams 22. Thus, it is possible to effectively reuse the lubricant, thereby reducing the discharge rate of the pump 31. As a result, the fuel efficiency of the engine improves.

The length of the nozzle 34 can be set as needed. Preferably, the lower end of the nozzle 34 is located closer to the camshaft 20 than the lower surface of the baffle plate 40 is, that is, the lower end of the nozzle 34 is located below the lower surface of the baffle plate 40 in the Y-direction indicated in the drawings. With this arrangement, the lubricant can accurately drop onto the cams 22. Because the supply port 36 is provided in each of the nozzles 34, the lubricant is effectively supplied to the cams 22. The lubricant shower 32 need not include the nozzles 34. However, it is preferable to provide the lubricant shower 32 with the nozzles 34 to allow the lubricant that has adhered to the surface of the lubricant shower 32 to efficiently drop onto the cams 22.

The number of the holes 42 of the baffle plate 40 and the number of the supply ports 36 of the lubricant shower 32 may be changed as needed. Preferably, the holes 42 and the supply ports 36 are located immediately above the respective cams 22. With this arrangement, it is possible to supply the lubricant to each of the cams 22, thereby reducing wear and seizure.

The blow-by gas flows through the gas passage 11 illustrated in FIG. 1A. The lubricant mixed into the blow-by gas is burned in the combustion chambers. This increases the consumption of the lubricant. In view of this, preferably, the partition walls 14 are disposed in the gas passage 11 to remove the lubricant from the blow-by gas. In addition, the baffle plate 40 is preferably located below the gas passage 11 in order to prevent the lubricant from entering the gas passage 11. A part of the lubricant scattered due to rotation of the camshafts 20 collides with the lower surface of the baffle plate 40. As a result, it is possible to restrain the lubricant from entering the gas passage 11 and to restrain the lubricant from being mixed into the blow-by gas.

First Modified Example

Figure 2B:
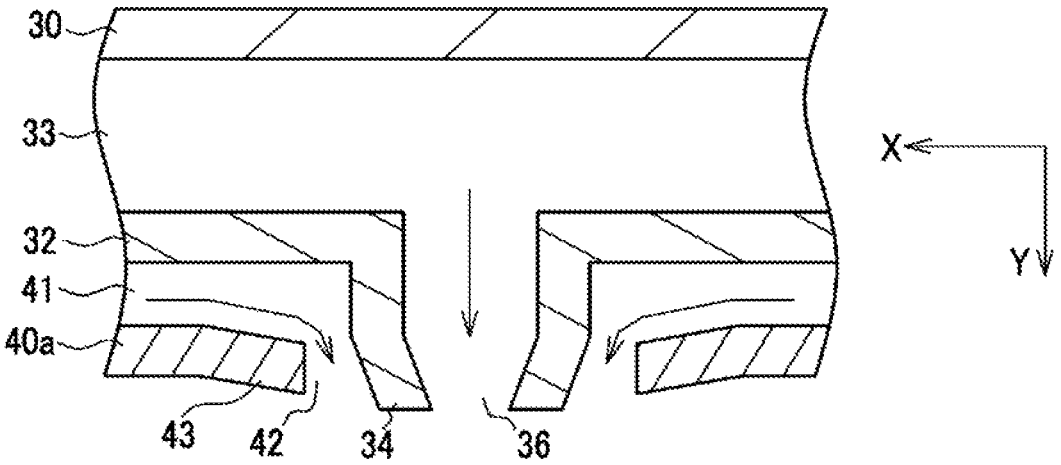
FIG. 2B is an enlarged view illustrating the hole of a baffle plate and the nozzle of the lubricant shower according to a first modified example.

FIG. 2B is an enlarged view illustrating the hole 42 of a baffle plate 40*a* and the nozzle 34 of the lubricant shower 32 according to a first modified example. The baffle plate 40*a* includes slanted portions 43 provided around the holes 42. The slanted portion 43 surrounds the hole 42 and the nozzle 34. The slanted portion 43 is slanted downward (toward the cam 22) as the slanted portion 43 extends toward the inside of the hole 42. The lubricant on the upper surface of the baffle plate 40*a* flows downward along the slanted portions 43, and then drops onto the cams 22. That is, the slanted portions 43 allow the lubricant to be effectively supplied to the cams 22. In addition, the baffle plate 40*a* is a plate including the slanted portions 43 provided around the holes 42. Because the baffle plate 40*a* is simply-structured, the baffle plate 40*a* is low in cost.

Second Modified Example

Figure 2C:
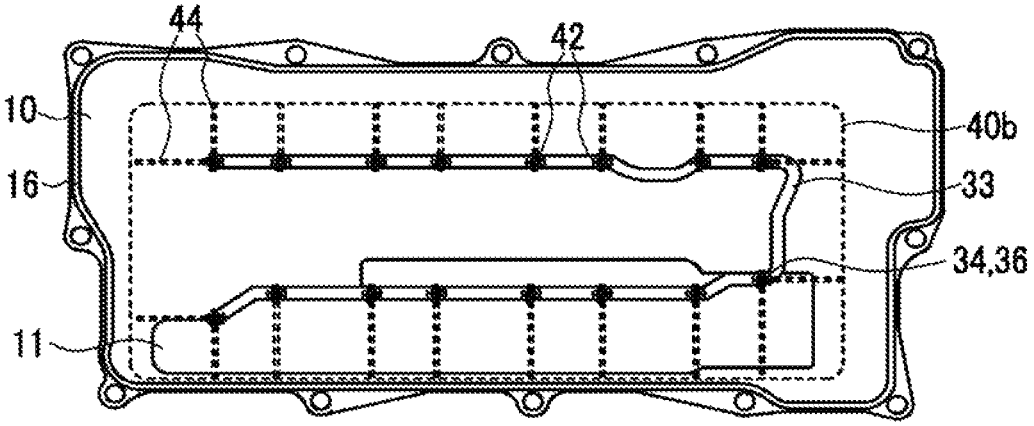
FIG. 2C is a plan view illustrating the cylinder head cover according to a second modified example.

FIG. 2C is a plan view illustrating the cylinder head cover 10 according to a second modified example. As illustrated in FIG. 2C, grooves 44 are provided in an upper surface of a baffle plate 40*b*. A first end of each groove 44 reaches the hole 42, and a second end thereof is located at an end portion of the baffle plate 40*b*. The grooves 44 are used as passages for the lubricant, so that the lubricant flows smoothly to the holes 42. The number of the grooves 44 and the shape of each groove 44 may be changed as needed.

Third Modified Example

Figure 3A:
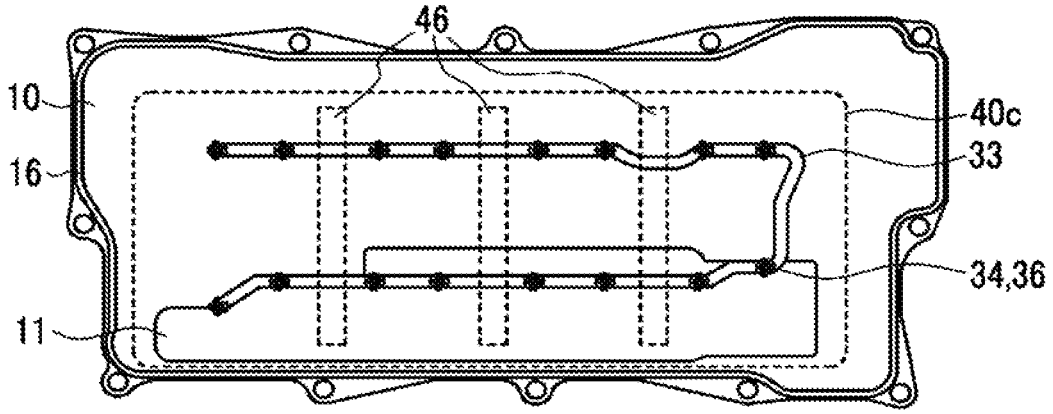
FIG. 3A is a plan view illustrating the cylinder head cover according to a third modified example.

FIG. 3A is a plan view illustrating the cylinder head cover 10 according to a third modified example. As illustrated in FIG. 3A, a baffle plate 40*c* is provided with a plurality of slits 46. The slits 46 extend through the baffle plate 40*c* from the cam 22-side (i.e., the lower side) to the lubricant shower 32-side (i.e., the upper side).

The lubricant scattered due to rotation of the camshafts 20 is introduced through the slits 46 onto the baffle plate 40*c*, and then adheres to an upper surface of the baffle plate 40*c*. This increases the amount of lubricant to be supplied from the upper surface of the baffle plate 40*c* to the cams 22 through the holes 42. That is, it is possible to promote collection and reuse of the lubricant. The number of the slits 46, the positions of the slits 46, the shape of each slit 46 and so forth may be changed as needed. For example, the slits 46 may be provided so as to correspond to each of all the holes 42.

Fourth Modified Example

Figure 3B:
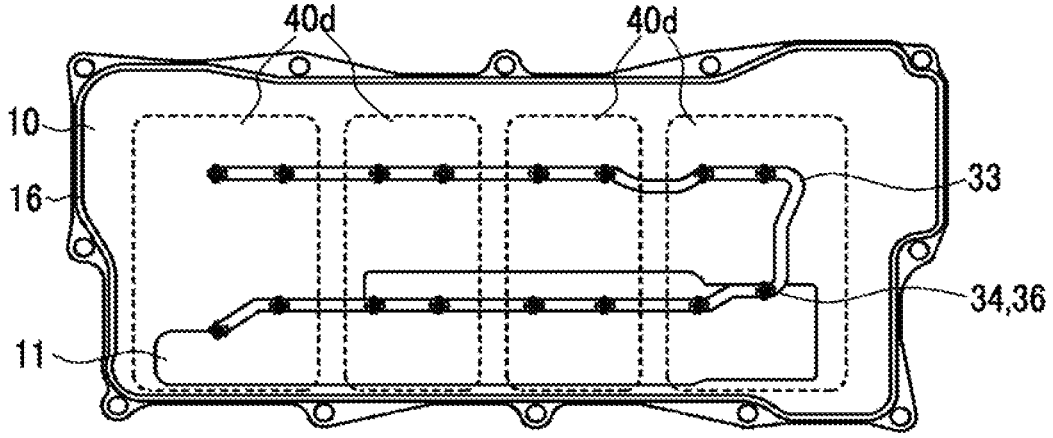
FIG. 3B is a plan view illustrating the cylinder head cover according to a fourth modified example.

FIG. 3B is a plan view illustrating the cylinder head cover 10 according to a fourth modified example. As illustrated in FIG. 3B, the cylinder head cover 10 is provided with a plurality of baffle plates 40*d*. The lubricant scattered due to rotation of the camshafts 20 is introduced onto the baffle plates 40*d* through clearances between the baffle plates 40*d*, and then adheres to upper surfaces of the baffle plates 40*d*. This increases the amount of lubricant to be supplied from the upper surfaces of the baffle plates 40*d* to the cams 22 through the holes 42. That is, it is possible to promote collection and reuse of the lubricant. The number of the baffle plates 40*d*, the layout of the baffle plates 40*d* and so forth may be changed as needed.

Fifth Modified Example

Figure 3C:
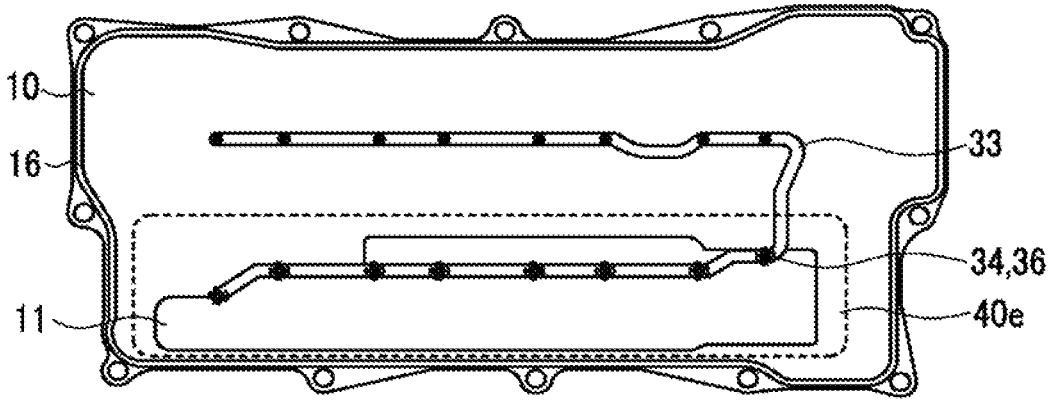
FIG. 3C is a plan view illustrating the cylinder head cover according to a fifth modified example.

FIG. 3C is a plan view illustrating the cylinder head cover 10 according to a fifth modified example. As illustrated in FIG. 3C, a baffle plate 40*e* is disposed below the gas passage 11, and the baffle plate 40*e* does not cover the entirety of the lower surface of the cylinder head cover 10. As in the foregoing embodiment, the baffle plate 40*e* shuts out the lubricant, thereby restraining the lubricant from entering the gas passage 11. In view of this, the baffle plate 40*e* is preferably disposed at least below the gas passage 11, within a region below the cylinder head cover 10. However, in order to effectively collect and reuse the lubricant, it is preferable to provide the baffle plate 40 that is large enough to cover a wide region (e.g., at least half the area) of the lower surface of the cylinder head cover 10, as illustrated in FIG. 1B. The foregoing embodiment and the first to fifth modified examples may be combined with each other as appropriate.

While the example embodiments of the disclosure have been described above in detail, the disclosure is not limited to the foregoing embodiments, and various modifications and changes may be made within the technical scope of the appended claims.

What is claimed is:

1. A lubricant supply apparatus for an internal combustion engine, the lubricant supply apparatus comprising:

a lubricant shower disposed between a camshaft and a cylinder head cover attached to a cylinder head, the lubricant shower including a supply port from which a lubricant is supplied to the camshaft; and a baffle plate disposed between the camshaft and the lubricant shower such that a clearance is provided between the baffle plate and the lubricant shower, the baffle plate including a hole provided at a position at which the hole of the baffle plate overlaps with the supply port of the lubricant shower, wherein the camshaft is provided with a cam, and the supply port of the lubricant shower and the hole of the baffle plate are located above the cam.

2. The lubricant supply apparatus according to claim 1, wherein:

the lubricant shower includes a nozzle protruding toward the camshaft;

the nozzle is provided with the supply port;

the nozzle is partially disposed in the hole of the baffle plate; and an inner wall of the baffle plate, the inner wall defining the hole, is apart from the nozzle.

3. The lubricant supply apparatus according to claim 2, wherein a lower end of the nozzle is located closer to the camshaft than a lower surface of the baffle plate is.

4. The lubricant supply apparatus according to claim 1, wherein the lubricant is supplied to the lubricant shower by a pump.

5. The lubricant supply apparatus according to claim 1, wherein the baffle plate includes a slanted portion provided around the hole, the slanted portion being slanted toward the cam.

6. The lubricant supply apparatus according to claim 1, wherein a groove is provided in an upper surface of the baffle plate.

7. The lubricant supply apparatus according to claim 1, wherein a slit is provided in the baffle plate.

* * * * *